US006378174B1

(12) United States Patent
Wong

(10) Patent No.: US 6,378,174 B1
(45) Date of Patent: Apr. 30, 2002

(54) WATERPROOF, WASHABLE PLASTIC MAGNETIC BUTTON AND A METHOD FOR MANUFACTURING THE SAME

(75) Inventor: Sheung Chung Wong, Kowloon (HK)

(73) Assignee: Hing Ngai Company Limited, Kowloon (HK)

( * ) Notice: Subject to any disclaimer, the term of this patent is extended or adjusted under 35 U.S.C. 154(b) by 19 days.

(21) Appl. No.: 09/606,547

(22) Filed: Jun. 29, 2000

Related U.S. Application Data

(63) Continuation-in-part of application No. 09/361,832, filed on Jul. 27, 1999.

(30) Foreign Application Priority Data

Jan. 12, 1999 (CH) ..... 99100120

(51) Int. Cl.[7] ..... A44B 1/04; A44B 21/00
(52) U.S. Cl. ..... 24/303; 24/66.1
(58) Field of Search ..... 24/303, 66.1; 292/251.5

(56) References Cited

U.S. PATENT DOCUMENTS 1,198,227 A * 9/1916 Hinchey ..... 24/303
2,319,292 A * 5/1943 Boggs ..... 24/303
2,363,914 A * 11/1944 Wakefield ..... 24/303
3,009,225 A * 11/1961 Budreck ..... 24/303
3,086,268 A * 4/1963 Chaffin, Jr. ..... 24/303
3,177,546 A * 4/1965 Bey ..... 24/303
3,254,440 A * 6/1966 Duggar ..... 24/303
3,378,893 A * 4/1968 Labek ..... 24/303
4,399,595 A * 8/1983 Yoon et al. ..... 24/303
4,991,270 A * 2/1991 Aoki ..... 24/303
5,450,658 A * 9/1995 Hicks ..... 24/303
5,732,451 A * 3/1998 Mars ..... 24/303

* cited by examiner

*Primary Examiner*—Victor Sakran
(74) *Attorney, Agent, or Firm*—Rabin & Berdo, P.C.

(57) ABSTRACT

The present invention relates to a magnetic button that is waterproof and washable and to the method for manufacturing the same. The magnetic button (1) according to the present invention comprises a button body (2), a magnet (7) and a steel plate (8) placed in the cavity (9) of said button body. The manufacturing method of the present invention comprises. Step A: manufacturing a button body (2) with non-magnetic material; step B: putting the magnet (7) and steel plate (8) into the cavity (9) of the button body; step C: the magnet and the steel plate are combined integrally and scaled in the button body (2) with a piece of sealing material (11) through the hot pressing process. The magnetic button of the present invention is waterproof and washable. When used on clothes, the buttons can be automatically aligned and match with each other. The button is best suited in the case where buttons are not easily unbuttoned with hands, for example, when hands are in gloves. It is particularly suited to children.

13 Claims, 4 Drawing Sheets

WATERPROOF, WASHABLE PLASTIC MAGNETIC BUTTON AND A METHOD FOR MANUFACTURING THE SAME

This application is a continuation-in-part application of co-pending U.S. patent application Ser. No. 09/361,832, filed Jul. 27, 1999 which claims the priority of Chinese patent application no. 99100120.6, filed Jan. 12, 1999.

FIELD OF THE INVENTION

The present invention relates to a kind of fastener and a method for manufacturing it, more particularly, to a waterproof and washable magnetic button and method for manufacturing it.

BACKGROUND OF THE INVENTION

The existing magnetic button used on articles, such as trunks, cases or bags, is usually composed of a magnetic button top cover and a magnetic button main body. The top cover of the magnetic button has fitting legs, and the magnetic button main body comprises a case, a magnet disposed inside the case and a button lower cover with fitting legs. Through the fitting legs disposed on the button top cover and button lower cover, the magnetic button is fixed on articles such as handbags, leather bags etc. which need frequent opening and closing for opening and closing them. However, such conventional magnetic button has not been able to be used on articles which also need frequent opening and closing such as overcoats, leather coats, fur clothing, suits etc. This is because the magnetism of the magnet used in prior art magnetic button is not strong enough (the magnetic field intensity is about 500 Gauss). In order to increase the magnetism, the only way is to increase the size or thickness of the magnet usually to 8 mm, which is not suitable for use on clothing. Secondly, there is no way to provide needle holes in such magnetic button for fixing the magnetic button, with thread on clothes as the ordinary buttons. Thirdly, as the prior art magnetic button is made by stamping the steel sheet, the occurrence of rust cannot be avoided though it is treated by electroplating or anticorrosive processing. And fourthly, consideration of waterproof property has not been given to prior art magnetic button, so it cannot be washed with water.

In order to overcome the above drawbacks of the conventional magnetic button and to extend the application scope of the magnetic button from articles such as handbags, leather bags, cases or portfolio etc., to the category of clothes, one object of the present invention is to provide a magnetic button which is waterproof and washable. The other object of the present invention is to provide a method for manufacturing of the magnetic button which is waterproof and washable.

SUMMARY OF THE INVENTION

The object of the present invention can be realized as follows: the magnetic button of the present invention comprises:

a button body, it has a front button face, the central portion of said front button face is a raised plane, its peripheral edge portion is lower than the raised plane of the front button face, in the said peripheral edge portion is defined a needling channel for affixing the magnetic button; the back face of the button body is a flat rear button face, a cavity is provided in-between the front button face and the rear button face; a magnet is placed in the cavity of the button body with one face being N pole and the other being S pole, a steel plate whose shape and size match with the shape and size of the magnet, with its peripheral edge extending vertically in one direction so that the extending edge just surrounds the magnet and the steel plate is placed on one surface of the magnet.

The method for manufacturing the magnetic button comprises the following steps:

Step A: making a button body with non-magnetic material such as polyvinyl chloride (PVC) or ABS soft plastics. Said button body has a front button face and the central portion of the front button face is a raised plane, the peripheral edge of the front button face is lower than the raised plane of the front button face, and in the peripheral edge is defined a needling channel for a sewing machine to fix the magnetic button with thread; a cavity is defined in the back face of the button body in a portion corresponding to the raised plane of the front button face, the shape and the size of the cavity match with the steel plate, in the periphery of the cavity has a concave groove, and the edge portion of the back face of the button body being a plane;

Step B: putting the magnet into the steel plate with a N or S magnetic pole, the steel plate, under the magnetic attractive force of the magnet, is joined together with the magnet with the vertically extending edge portion of the steel plates just surrounding the magnet; if the magnet is placed in the steel plate with N pole against the steel plate, a sign A1 is given to the magnetic button thus formed; if the magnet is placed in the steel plate with S pole against the steel plate, the magnetic button thus formed is given a sign B1, then the joined magnet and the steel plate are placed in the cavity with the magnet surface being put tightly against the front button face;

Step C: a piece of sealing material made of the same material as that of the button body and having the size matching with the concave groove in the back face of the button body is placed in the concave groove and by means of hot pressing technique the sheet packing is made combined with the button body integrally, so that the magnet and the steel plate are sealed in the button body, after the sealing, the back face of the button presents a generally flat surface. Obviously, the magnetic button manufactured according to the method of the present invention is waterproof and washable because it is surrounded and sealed by non-magnetic material. Furthermore, because a needling channel is provided in the edge portion of the magnetic button for sewing with the sewing machine, the magnetic button of the present invention can be used on clothing, handbags, cases, trunks, knapsack and bags. In addition, as the magnetic button according to the present invention can automatically attract and join with each other due to its strong magnetic force, it is well suited for use in cold weather or in the situation where the button cannot be unbuttoned due to cold weather or other causes, and it is particularly suitable for use with children who do not know how to use buttons.

BRIEF DESCRIPTION OF DRAWINGS

In the following, the present invention will be described in details with reference to the accompanying drawings and preferred embodiments.

DETAILED DESCRIPTION OF PREFERRED EMBODIMENT

Figure 1:
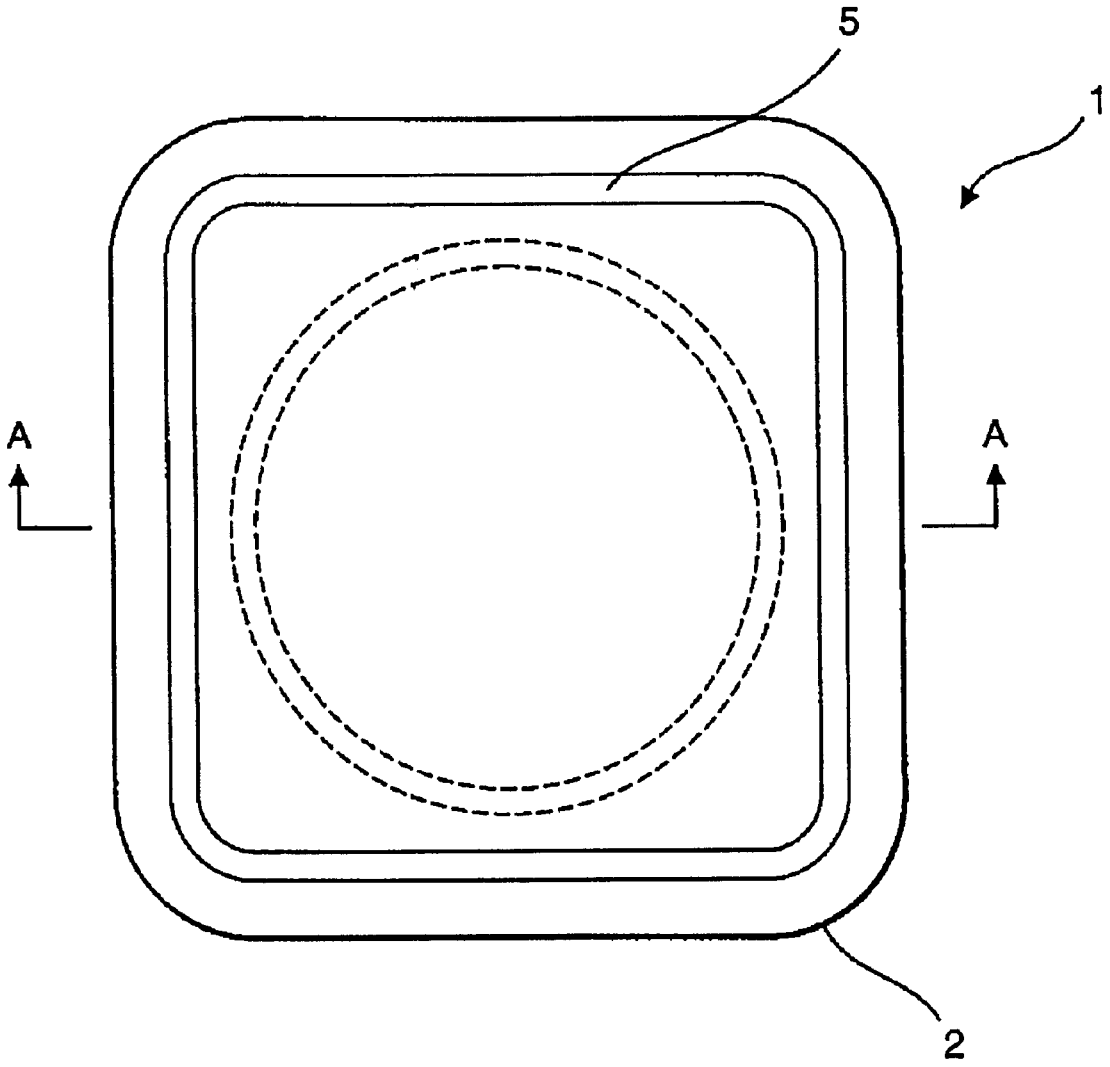
FIG. 1 is a schematic view of a magnetic button according to present invention.
Figure 2:
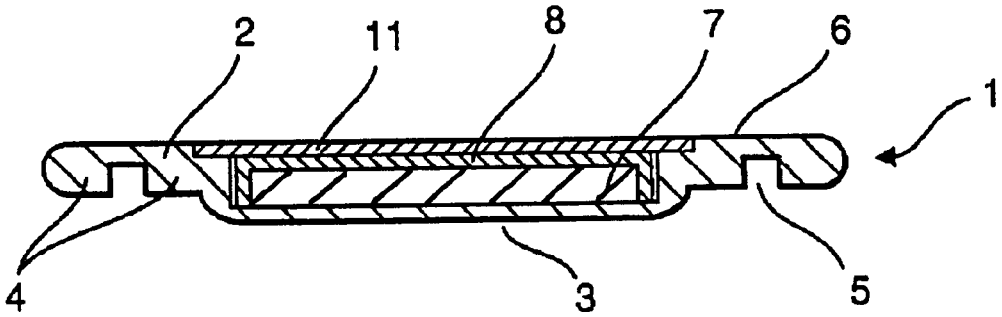
FIG. 2 is a sectional view along line A—A in FIG. 1.

Referring to FIG. 1 and FIG. 2, the magnetic button 1 according to the present invention comprises a button body 2 with a front button face 3. The central portion of the front button face 3 is a raised plane, and its peripheral edge portion 4 is lower than the raised plane of the front button face 3. Needling channels 5 are provided in the peripheral edge portion 4 for fixing the magnetic button with a sewing machine etc. The back of the button body 2 is a flat rear button face 6. A cavity is defined between the front button face 3 and rear button face 6. A magnet 7 is placed in the cavity of the button body 2, with one surface being a N pole and the other an S pole. A steel plate 8 is provided, with the shape and size thereof matching with the shape and size of the magnet 7. The peripheral edge of the steel plate extends vertically in one direction so that the extending peripheral edge just surrounds the magnet 7, i.e., the steel plate is placed on one face of the magnet 7, and the height of the extending peripheral edge is substantially equal to the thickness of the magnet 7.

The button body 2 has generally a round or square shape, but it can be made into an oval, triangle, etc. as required by the clothing. On the front button face 3 various ornament patterns can be arranged according to requirements. The button body is made of non-magnetic material such as polyvinyl chloride (PVC), ABS soft plastics etc. by an injection molding technique. This thickness (D) of the button body 2, i.e. the vertical distance between the front button face and the rear button face is 2.5~3.5 mm. The magnet 7 is made of a strong magnetic alloy such as neodymium-iron-boron magnetic alloy, which has a magnetic field intensity up to 1500 Gauss, which is three times that of the magnet currently used in the conventional magnetic buttons (the magnetic field intensity is about 500 Gauss). Besides, the thickness of the magnet 7 adopted by the present invention is 1.0~1.5 mm, while the ordinary magnetic buttons, even if the thickness is increased to 8.0 mm, cannot still achieve the required magnetic force. The most commonly adopted shape of the magnetic button is round, with one side being an N pole and the other being an S pole.

The purpose of using the steel plate 8 is to concentrate the magnetic force onto the button face in collaboration with the magnet, that is to say, to increase the magnetic force on the surface of the button face, and at the same time to decrease the magnetic force on the rear button face. The steel plate 8 is formed by pressing or compacting the steel sheet. Its thickness is 0.6~0.8 mm.

Figure 3:
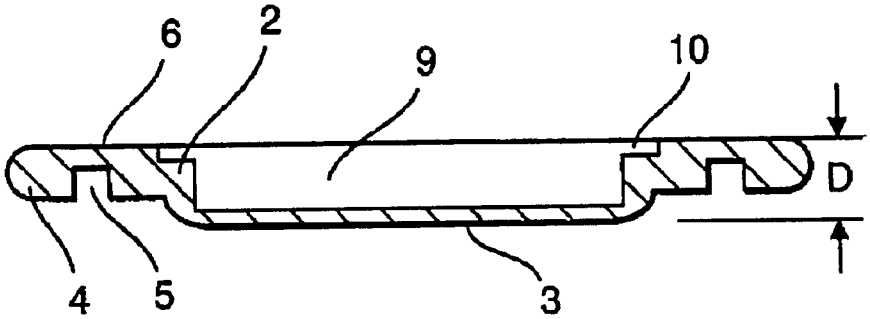
FIG. 3 is a sectional view of the button body of the magnetic button according to the present invention.
Figure 4:
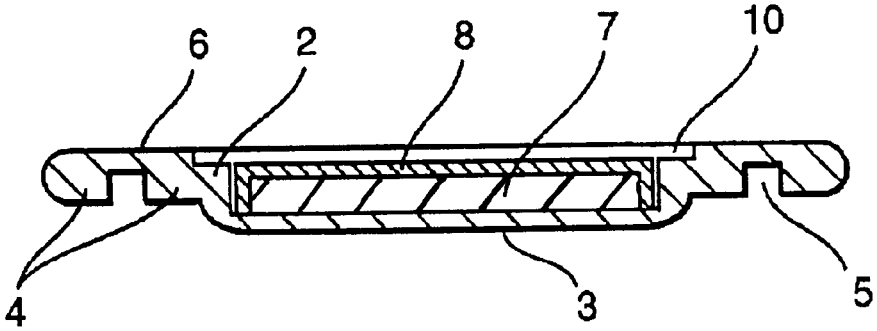
FIG. 4 is a sectional view of the button body with magnet and steel plate placed but not yet sealed in it.

The method for manufacturing the magnetic button 1 comprises the following steps:

Step A: making a button body 2 with non-magnetic materia7l, (refer to FIG. 3), which button body has a decorative front button face 3. The central portion of the front button face 3 is a raised plane. The peripheral edge portion 4 of the front button face 3 is lower than the raised plane of the front button face 3. In the peripheral edge portion 4 is provided needling channels 5 for affixing the magnetic button 1. A cavity 9 is defined in the rear portion of the button body 2 in the portion corresponding to the raised plane or portion of the front button face 3. The shape and size of the cavity matches with the steel plate. A concave groove 10 is defined in the periphery of the cavity 9 and the edge portion of the back (rear) face of the button body 2 is a planar surface;

Step B: placing the magnet 7 into the steel plate 8 in a fixed magnetic pole direction with one face being an N pole or an S pole. The steel plate 8, under the magnet 7, is joined together with the vertically extending edge portion surrounding just the magnet 7; if the magnet 7 is placed in the steel plate 8 with an N pole being put against the steel plate, the formed magnetic button is given a sign A1. If the magnet 7 is placed in and against the steel plate 8 with an S pole, the formed magnetic button is given a sign B1. Then the joined magnet 7 and steel plate 8 are put into the cavity 9 of the button body with the face of the magnet being lightly placed against the front button face 3 (refer to FIG. 4).

Step C: a piece of sealing material 11, made of the same material as the button body 2 and having the size matching with the concave groove 10 in the back (rear) surface of the button body, is placed in the concave groove 10. By means of a hot pressing process, the piece of sealing material 11 is combined integrally with the button body 2 so that the magnet 7 and the steel plate 8 are sealed in or within the button body 2. After sealing, the rear (back), face of the button body presents a generally planar surface (refer to FIG. 2).

Figure 5:
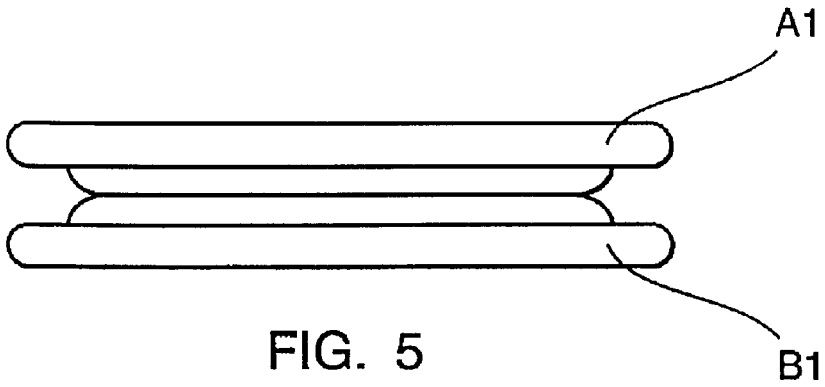
FIG. 5 is a schematic view showing two magnetic buttons are joined together by the magnetic force.
Figure 6:
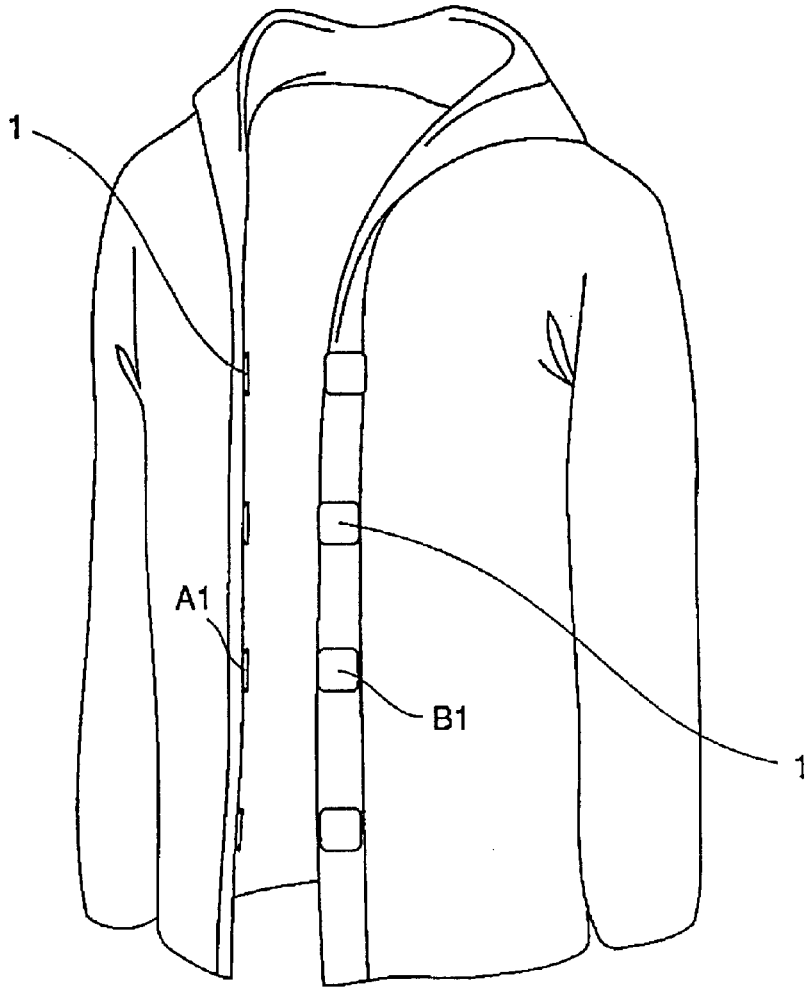
FIG. 6 is a schematic view of a suit using the magnetic button of the present invention.

The magnetic buttons A1, A2 made through the above steps can be separately sewn on the clothes to be used as buttons. Referring to FIG. 5, the magnetic buttons A1 of the present invention are sewn on the positions of a row of buttons for a coat, and the magnetic buttons B1 of the present invention are sewn on the corresponding positions of the coat on the opposite side. As the polarities of the magnetic buttons A1 and B1 are of different magnetic polarity, they not only automatically attract and join with each other, but also can automatically align the positions of the two opposite buttons without deviation, so it is very convenient for use. When putting on the clothes with the magnetic buttons of the present invention, you can hear the sound of automatic buttoning of the magnetic buttons. When taking off the clothes, the button can be separated with little force.

Alternatively, the magnetic buttons of the present invention can be sewn on the coat in a row and the opposite row can be sewn with button covers. The convenience and the use are the same as above, but the attraction of magnetic force is lower than the above magnetic buttons.

Figure 7:
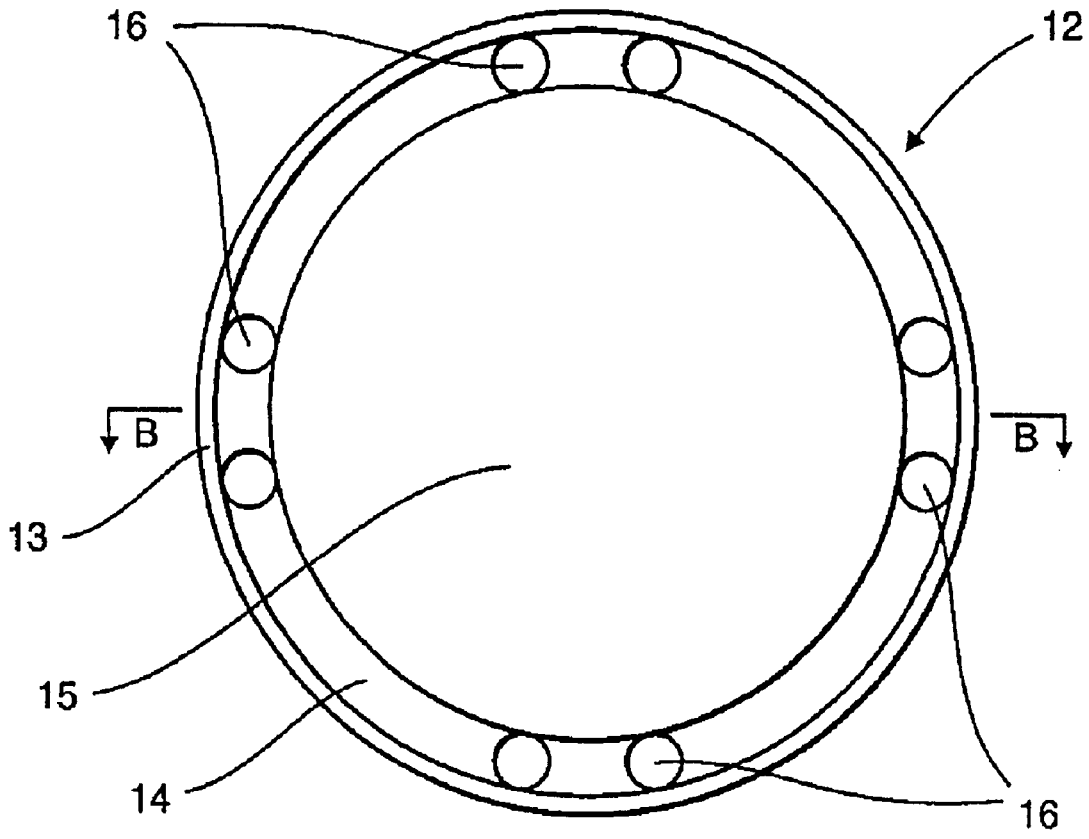
FIG. 7 is a schematic view of the button cover of the magnetic button of the present invention.
Figure 8:
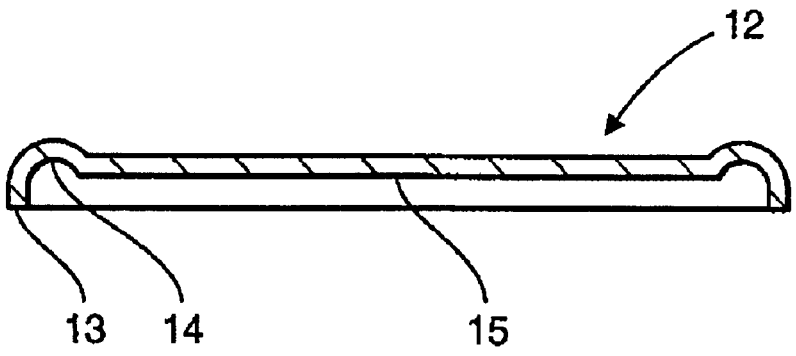
FIG. 8 is a sectional view of the button cover along line B—B in FIG. 7.

Referring to the FIG. 7 and FIG. 8, the button cover 12 is formed by pressing the steel sheet. The bottom cover 12 undergoes an anti-rust treatment such as electroplating or baking finish. Its external shape can match with the magnetic button. It is generally round or square in shape. There is a vertically extending surrounding edge 13 provided around it.

Closely next to the surrounding edge 13 is an annular or O-ring groove 14. A little inward is a plane 15 which attracts the magnetic button. In in the annular or O-ring groove 14 are provided through holes 16 for fixing the cover.

The magnetic buttons can be used also on hand bags, trunks, and bags.

The above is merely an example of the present invention, it is to be noted that those skilled in the art can make various modification and alterations to it based on the disclosure without departing form the principle of the present invention. Therefore such modifications and alterations would also fall within the protection scope of the present invention.

What is claimed is:

1. A magnetic button, comprising:

a button having a front button face, a central portion of said front button face being a raised surface, with a surrounding edge portion of said front button face being lower than the raised surface of the front button face, said edge portion having needling channels provided therein for affixing the magnetic button, a back side of the magnetic button having a flat rear button face, a cavity being defined in-between the front button face and the rear button face; and a magnet placed in the cavity of the button body, with one side of the magnet being an N pole and the other side being an S pole.

2. The magnetic button according to claim 1, wherein said button body is made of a non-magnetic material.

3. The magnetic button according to claim 2, wherein the non-magnetic material is selected from the group consisting of polyvinyl chloride (PVC) and ABS soft plastics.

4. The magnetic button according to the claim 1, wherein said magnet is made of neodymium-iron-boron alloy of strong magnetism.

5. The magnetic button according to claim 1, wherein a thickness of said button body is 2.5~3.5 mm.

6. The magnetic button according to claim 1, wherein a thickness of said magnet is 1.0~1.5 mm.

7. The magnetic button according to claim 1, wherein the needling channel is a groove that extends continuously around an entire periphery of said button body.

8. The magnetic button according to claim 1, wherein the needling channel is an elongated groove that is disposed at a periphery of said button body, the groove being spaced away from an outermost edge of said button body.

9. A magnetic button, comprising:

a button body having a front button face, a central portion of said front button face being a raised surface, with a surrounding edge portion of said front button face being lower than the raised surface of the front button face, said edge portion having needling channels provided therein for affixing the magnetic button, a back side of the magnetic button having a flat rear button face, a cavity being defined in-between the front button face and the rear button face;

a magnet placed in the cavity of the button body, with one side of the magnet being an N pole and the other side being an S pole; and having an edge extending vertically such that the extending edge just surrounds the magnet, a shape and size of the steel plate matching with the magnet so that when the steel plate is placed on one surface of the magnet, the height of the extending edge is about equal to a thickness of the magnet.

10. The magnetic button according to claim 9, wherein a thickness of the steel plate is 0.6~0.8 mm.

11. The magnetic button according to claim 10, wherein said button body is made of a material selected from the group consisting of polyvinyl chloride (PVC) and ABS soft plastics, a thickness of the button body being 2.5~3.5 mm.

12. The magnetic button according to claim 10, wherein said magnet is made of neodymium-iron-boron alloy of strong magnetism, a thickness of said magnet being 1.0~1.5 mm.

13. A method for manufacturing a magnetic button, comprising:

making a button body with non-magnetic materials, the button body having a front button face, a central portion of the front button face being a raised plane, with a surrounding edge portion of the front button face being lower than the raised plane of the front button face, the edge portion having needling channels defined therein for affixing the magnetic button, a cavity being provided in a back of the button body in a portion corresponding to the raised plane of the front button face, a shape and size of the cavity matching with a steel plate, a concave groove being provided around the cavity, and the back of the button body being a smooth surface;

placing a magnet into the steel plate in a fixed magnet pole direction, the steel plate being joined together with the magnet using an attractive force of the magnet, with a vertically extending edge of the steel plate just surrounding the magnet, wherein when an N pole of the magnet is put into the steel plate, then the magnetic button thus formed is given a sign (A1); and wherein when an S pole of the magnet is put into the steel plate, then the magnetic button thus formed is given a sign (B1);

after said placing, putting the magnet and the steel plate which are joined together by magnetic force into the cavity with a face of the magnet pressing tightly against the front button face;

putting a piece of sealing material made of a same material as that of the button body and having a size matching with the concave groove into the concave groove; and through a hot pressing technique, combining the piece of sealing material integrally with the button body so that the magnet and the steel plate are sealed within the button body, after the sealing, the back face of the button body is generally a smooth surface.

* * * * *